US005755626A

United States Patent [19]

Shira

[11] Patent Number: 5,755,626

[45] Date of Patent: May 26, 1998

[54] SELECTIVE WEAR RESISTANCE ENHANCEMENT OF STRIKING SURFACE OF GOLF CLUBS

[75] Inventor: Chester S. Shira, San Diego, Calif.

[73] Assignee: Carbite, Inc., San Diego, Calif.

[21] Appl. No.: 824,321

[22] Filed: Mar. 26, 1997

[51] Int. Cl.[6] ..... A63B 53/04

[52] U.S. Cl. ..... 473/330; 473/331; 473/409

[58] Field of Search ..... 473/324, 330, 473/331, 327, 329, 332, 349, 350, 409

[56] References Cited

U.S. PATENT DOCUMENTS

| | | | |
|---|---|---|---|
| 2,908,502 | 10/1959 | Bradstreet . | |
| 3,855,029 | 12/1974 | Sabel . | |
| 3,989,861 | 11/1976 | Rasmussen . | |
| 4,754,975 | 7/1988 | Aizawa . | |
| 4,768,787 | 9/1988 | Shira . | |
| 4,917,384 | 4/1990 | Caiati | 473/330 |
| 5,029,865 | 7/1991 | Kim | 473/330 |
| 5,100,144 | 3/1992 | Okumoto et al. . | |
| 5,303,922 | 4/1994 | Lo . | |
| 5,358,249 | 10/1994 | Mendralla | 473/331 |
| 5,437,088 | 8/1995 | Igarashi | 473/331 |

FOREIGN PATENT DOCUMENTS

| | | | |
|---|---|---|---|
| 52-21937 | 2/1977 | Japan | 273/167 J |
| 404109975 | 4/1992 | Japan | 273/167 J |
| 404341282 | 11/1992 | Japan | 273/167 J |

*Primary Examiner*—Sebastiano Passaniti
*Attorney, Agent, or Firm*—John L. Gray

[57] ABSTRACT

The invention involves a golf club which has a ball striking surface with horizontally extending grooves on it in which the upper edges of the grooves are harder than the lower edges. The upper edges of the grooves on the ball striking surface are selectively made harder either by directional or non-directional surface treatment processes or by making them from materials which are harder than the materials from which the lower edges of the grooves are made.

19 Claims, 2 Drawing Sheets

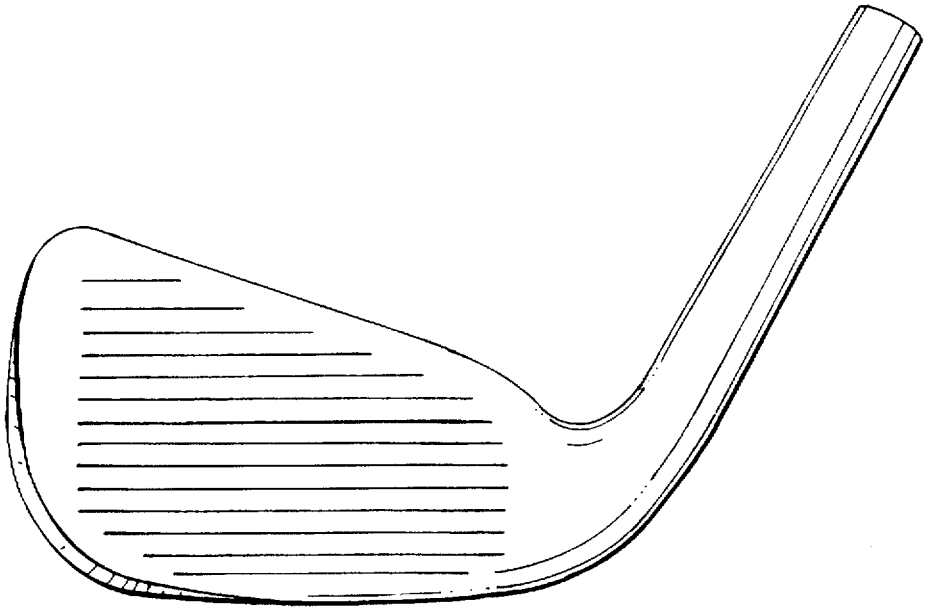
Fig. 1
Fig. 2
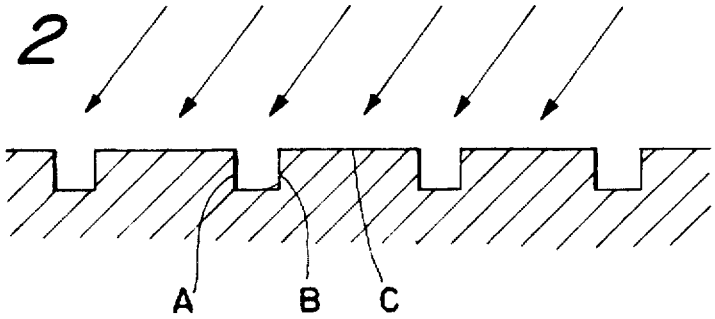
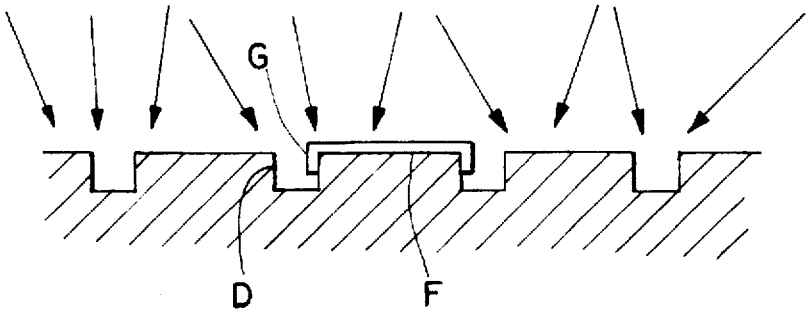
Fig. 3

SELECTIVE WEAR RESISTANCE ENHANCEMENT OF STRIKING SURFACE OF GOLF CLUBS

Background of the Invention

This invention relates to golf club heads and more particularly to a method of treating a golf club's ball striking surface so that the upper edges of the grooves on the ball striking surface are harder than the lower edges of the grooves and to golf club heads made by this method.

In making golf clubs, it is desirable that the ball striking surface of the clubs have high friction. High friction is necessary to impart back spin to the golf ball at the time it is struck. This allows greater control over the ball after it has been hit, so that the ball will attain the desired flight trajectory and the stopping or rolling distance of the ball will be minimized.

This is currently accomplished by cutting horizontal grooves in the club's ball striking surface. It is well known that the application of spin to a golf ball is greatly affected by the shape, depth, and width of these grooves. In particular, the upper edge of the grooves is most effective in creating back spin if it is relatively sharp featured. However, the surface of the golf club's ball striking surface will wear during use. The wear is due to erosion caused by repeated striking of golf balls and the soil or surfaces under and around the golf ball. As the upper edge groove radius wears, it becomes less and less effective in imparting back spin to the golf ball.

Many methods have been tried to extend the life of the golf club's ball striking surface and to create a better frictional grip between the ball and club's ball striking surface. Hard surfacing compounds have been plasma sprayed on the ball striking surface. Ball striking surfaces have been carburized and nitrided to extend wear and to create a desired patina or coloration. Ceramic substances have been flame sprayed on the ball striking surface to improve wear resistance and to create a desired coloration. Ball striking surfaces have also been sandblasted. Ion implantation techniques have been used to harden a previously roughened surface. Another method involves producing a composite of hard particles in a softer metal matrix as taught in U.S. Pat. No. 4,768,787, Shira. With all of these methods, the golf club's ball striking surface wears in a reasonably uniform manner.

It is therefore an object of this invention to provide an improved method for making a golf club head.

It is another object of this invention to provide a golf club having a ball striking surface with improved wear-resistance.

It is still another object of this invention to provide a golf club having a ball striking surface with a selective wear pattern.

These, together with other objects and advantages of the invention will become more readily apparent to those skilled in the art when the following general statements and descriptions are read in light of the appended drawings.

BRIEF SUMMARY OF THE INVENTION

Applicant has discovered that the selective treatment of the upper edges of the grooves on a golf club's ball striking surface can extend the useful life of the club. The invention involves a method of treating a golf club's ball striking surface which has horizontally extending grooves on it, which method comprises the step of making the upper edges of the grooves harder than the lower edges of the grooves by surface treatment of the upper edges of the grooves. The surface treatment can be directional or non-directional. With non-directional surface treatment, the method comprises the steps of depositing a masking material on the lower edges of the grooves whereby the lower edges are protected from treatment, and then making the upper edges of the grooves harder than the lower edges of the grooves by non-directional surface treatment of the upper edges of the grooves.

Examples of directional surface treatment processes include the use of an electron beam, a laser beam, ion implantation, sputtering, plasma spray or treatment, and various tungsten arc and spark transfer processes. Non-directional surface treatment processes include chemical vapor deposition, plating, carburizing, nitriding, and plasma vapor deposition.

The invention also relates to a golf club provided with a ball striking surface having horizontally extending grooves on it in which the upper edges of the grooves are harder than the lower edges. The upper edges of the grooves on the ball striking surface are selectively made harder either by directional or non-directional surface treatment processes or by making them from materials which are harder than the materials from which the lower edges of the grooves are made.

Golf clubs made according to the invention with grooves in which the upper edges are harder than the lower edges have selective wear patterns. The upper edge wears more slowly than the lower edge. The maintenance of the sharp upper groove edges in the present invention provides predictable, high spin rates on golf balls for significantly longer than current clubs are able to offer.

BRIEF DESCRIPTION OF THE DRAWINGS

FIG. 1 is a side elevation view of a golf club showing the ball striking surface.

FIG. 2 is a section of the golf club shown in FIG. 1 showing a directional surface treatment process.

FIG. 3 is a section of the golf club shown in FIG. 1 showing a non-directional surface treatment process.

DETAILED DESCRIPTION OF THE INVENTION

Figure 4:
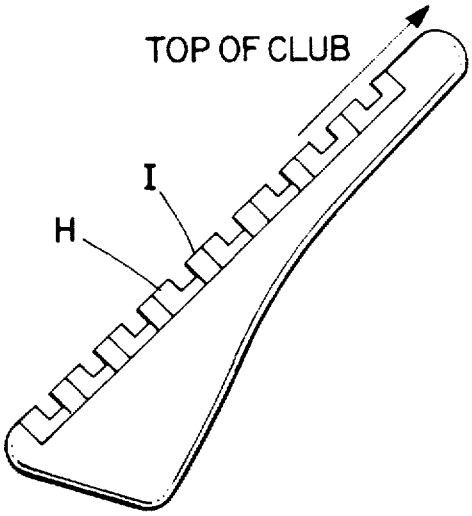
FIG. 4 is a cross-section of a golf club's ball striking surface made according to an alternative embodiment of the present invention.

FIG. 1 shows a golf club's ball striking surface. The ball striking surface has horizontal grooves cut into it. The present invention involves the selective treatment of the horizontal grooves in order to obtain a harder surface on the upper edge of the grooves. The selective treatment will work on grooves of any shape. Typically, grooves are square, U-shaped, or V-shaped.

The surface treatment of the upper edges of the grooves can be achieved by either directional or non-directional surface treatment processes. A directional surface treatment is one in which the treatment can be directed to a desired area. Examples of directional surface treatments include the use of an electron beam, a laser beam, ion implantation, sputtering, plasma spray, and various tungsten arc and spark transfer processes.

FIG. 2 shows a typical directional surface treatment on a ball striking surface. The ball striking surface has face portion C. The grooves have upper edge A and lower edge B.

The treatment source impinges on the ball striking surface at an angle to the surface. The angle of impingement can be any angle which is effective to treat the upper edge A and face portions C of the ball striking surface making them harder than the lower edge B. The angle of impingement is typically between 20° and 70°, and is preferably 45°. The directional surface treatment as shown in FIG. 2 will not treat the lower edge B or lower side of the groove. The upper side of the groove will have varying amounts of treatment depending on the distance down from the upper edge A, the process used, and the angle of impingement, but it will not receive as much treatment as the upper edge A or the face portions C. The bottom of the groove may also have some treatment depending on the process used and the angle of impingement, but it will not receive as much treatment as the upper edge A or the face portion C.

The effect of the directional surface treatment is to make upper edge A of the groove harder than lower edge B. Because of this difference in hardness, the lower edge of the groove will wear faster than the upper edge during the use of the golf club. The harder upper edges will keep their sharp edges longer. Maintaining this sharp upper edge on the grooves allows extended life for the ball striking surface.

FIG. 3 shows the use of a non-directional surface treatment. In non-directional surface treatments, the treatment cannot be directed to a particular area, but instead will treat the entire surface. Because selective treatment of the edges of the grooves is necessary, the surface of lower edge E must be covered with a masking material G prior to surface treatment with a non-directional surface treatment. The masking material G is intended to prevent the non-directional surface treatment from treating the lower edge E of the groove. Selection of the proper masking material will depend on the process to be used. A barrier material could be applied, such as a metallic or ceramic coating in slurry form. Another example would be an adhesively attached strip of metallic or ceramic material.

After the lower edge E and part of face portion F have been covered with the masking material G, the non-directional surface treatment may be applied. The upper edge D and face portion F will be selectively hardened. The use of the non-directional surface treatment will result in varying amounts of treatment on the upper side, the lower side, and the bottom of the groove, but none of these will receive as much treatment as the upper edge D and face portions F.

Chemical vapor deposition, plating, carburizing, nitriding, and plasma vapor deposition are examples of non-directional surface treatments.

Surface enhancing materials can be used with either directional or non-directional surface treatment processes. Examples of surface enhancing materials include painted slurry coatings of finely divided particles of hardfacing compounds or elements coupled with the use of ion bombardment and selective hardening using laser beams. Finely divided particles which are useful are those ranging in size from −100 to +600 mesh. These are typically identified as carbides, nitrides, ceramics, diamonds, nickel carbon and the family of silicon-carbon-boron containing brazing alloys. Additionally, in the case of laser beams or directed heat sources, these compounds or elements may be injected into the beam or molten surface of the work piece by means of a delivery tube or nozzle directed towards the molten surface. Thus, surface enhancing materials comprising hard particles or hardening agents can be applied prior to or in conjunction with the surface treatment process.

FIG. 4 shows an alternative embodiment of a golf club's ball striking surface made according to the invention. In this embodiment, the selective hardening of the upper edges of the grooves is achieved by making the ball striking surface from alternating sections H and I of materials having differing hardness.

Figure 5:
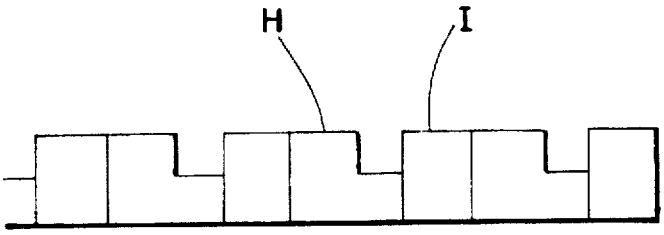
FIG. 5 is an enlarged view of FIG. 4 showing alternating hard and soft wear-resistant materials.

FIG. 5 shows an enlarged view of FIG. 4. In FIG. 5, the ball striking surface is made from alternating sections H and I. Section H includes the lower edge of the groove. Section I, which includes the upper edge of the groove, is made from a material which is harder than the material from which section H is made. For example, the harder material could be a heat treatable stainless steel, such as 17-4 PH with a Rockwell hardness Rc of 25 to 40. The softer material could be type 304 stainless steel with a Rockwell hardness Rb of 75 to 90. These materials are listed for purposes of illustration only and are not intended to limit the invention. One skilled in the art would be able to select appropriate materials from which to make sections H and I.

Sections H and I could be assembled into a club face using a variety of known joining processes, including diffusion bonding, brazing, hot isostatic pressing or adhesives. They could be assembled in the golf club face or applied as an inert assembly.

Surface enhancing materials, as discussed above, may also be incorporated in either or both sections H and I.

While this invention has been shown and described with respect to a detailed embodiment thereof, it will be understood by those skilled in the art that various changes in form and detail thereof may be made without departing from the scope of the claims of the invention.

What is claimed is:

1. A method of treating a ball striking surface of a golf club wherein said ball striking surface is provided with horizontally extending grooves therein, said grooves having upper edges and lower edges located adjacent said ball string surface, said upper edges being disposed substantially vertically above said lower edges when said ball string surface is held in a generally vertical ball addressing position, said method comprising the step of making upper edges of said grooves harder than the lower edges of said grooves by surface treatment of said upper edges of said grooves.

2. The method of claim 1, wherein said surface treatment is a directional surface treatment.

3. The method of claim 2, wherein said directional surface treatment includes the use of an electron beam.

4. The method of claim 2, wherein said directional surface treatment includes the use of a laser beam.

5. The method of claim 2, wherein said directional surface treatment includes the use of ion implantation.

6. The method of claim 2, wherein said directional surface treatment includes the use of sputtering.

7. The method of claim 2, wherein said directional surface treatment includes the use of plasma spray.

8. The method of claim 2, wherein said directional surface treatment includes the use of arc processes.

9. The method of claim 2, wherein said directional surface treatment includes the use of spark transfer processes.

10. A method of treating a ball stirring surface of a golf club wherein said striking surface is provided with horizontally extending grooves thereon, said grooves having upper edges and lower edges located adjacent said ball striking surface, said upper edges being disposed substantially vertically above said lower edges when said ball striking surface is held in a generally vertical ball addressing position, which method comprises the steps of:

(i) depositing a masking material on lower edges of said grooves whereby said lower edges are protected from treatment; and (ii) making upper edges of said grooves harder than said lower edges of said grooves by non-directional surface treatment of said upper edges of said grooves.

11. The method of claim 10, wherein said non-directional surface treatment includes the use of chemical vapor deposition.

12. The method of claim 10, wherein said non-directional surface treatment includes the use of plating.

13. The method of claim 10, wherein said non-directional surface treatment includes the use of carburizing.

14. The method of claim 10, wherein said non-directional surface treatment includes the use of nitriding.

15. The method of claim 10, wherein said non-directional surface treatment includes the use of plasma vapor deposition.

16. A golf club provided with a ball striking surface wherein said ball striking surface is provided with horizontally extending grooves thereon, said grooves having upper edges and lower edges located adjacent said ball striking surface, said upper edges being disposed substantially vertically above said lower edges when said ball striking surface is held in a generally vertical ball addressing position, said upper edges of said grooves being harder than said lower edges of said grooves.

17. The golf club of claim 16, wherein said upper edges of said grooves on said ball striking surface are selectively made harder by directional surface treatment.

18. The golf club of claim 16, wherein said upper edges of said grooves on said ball striking surface are selectively made harder by non-directional surface treatment.

19. The golf club of claim 16, wherein said upper edges of said grooves on said ball striking surface are made from materials which are harder than the materials from which said lower edges of said grooves are made.

* * * * *